US007713174B2

(12) United States Patent
Xiang

(10) Patent No.: US 7,713,174 B2
(45) Date of Patent: May 11, 2010

(54) TRAMPOLINE ENCLOSURE NET

(75) Inventor: Li Ru Xiang, Dong Guan (CN)

(73) Assignee: Sportspower, Ltd., Kowloon (HK)

( * ) Notice: Subject to any disclaimer, the term of this patent is extended or adjusted under 35 U.S.C. 154(b) by 160 days.

(21) Appl. No.: 12/012,043

(22) Filed: Jan. 31, 2008

(65) Prior Publication Data

US 2009/0111659 A1 Apr. 30, 2009

(30) Foreign Application Priority Data

Oct. 29, 2007 (CN) ..... 2007 2 0058817 U

(51) Int. Cl.
*A63B 5/11* (2006.01)

(52) U.S. Cl. ..... 482/29; 482/27

(58) Field of Classification Search ..... 482/27–32; 473/492, 494; 135/88.11, 88.12, 112, 117, 135/123, 144, 913, 20.3; 256/12.5
See application file for complete search history.

(56) References Cited

U.S. PATENT DOCUMENTS

| | | | | |
|---|---|---|---|---|
| 3,201,126 | A * | 8/1965 | Nissen | 273/393 |
| 3,645,370 | A * | 2/1972 | Rodwell et al. | 194/241 |
| 5,358,257 | A * | 10/1994 | Pardi | 473/493 |
| 6,622,742 | B1 * | 9/2003 | Hanna | 135/88.12 |
| 6,852,046 | B1 * | 2/2005 | Wewel et al. | 473/463 |
| 6,926,626 | B2 * | 8/2005 | Scarpa, III | 473/492 |
| 7,399,243 | B2 * | 7/2008 | Schank et al. | 473/492 |
| 2002/0065153 | A1 * | 5/2002 | Bertrand | 473/492 |
| 2003/0130075 | A1 * | 7/2003 | Brosens | 473/492 |
| 2004/0121883 | A1 * | 6/2004 | Publicover | 482/29 |
| 2005/0079954 | A1 * | 4/2005 | Wang et al. | 482/27 |
| 2006/0058157 | A1 * | 3/2006 | Greiner et al. | 482/27 |
| 2006/0189441 | A1 * | 8/2006 | VanElverdinghe et al. | 482/27 |
| 2006/0189442 | A1 * | 8/2006 | Publicover | 482/27 |
| 2006/0194674 | A1 * | 8/2006 | Hickey | 482/27 |
| 2006/0270525 | A1 * | 11/2006 | Colling | 482/27 |
| 2007/0004560 | A1 * | 1/2007 | Nelson | 482/29 |
| 2007/0129185 | A1 * | 6/2007 | Schank et al. | 473/492 |
| 2008/0009394 | A1 * | 1/2008 | VanElverdinghe et al. | 482/29 |
| 2008/0269019 | A1 * | 10/2008 | Lovley, II | 482/27 |
| 2008/0269020 | A1 * | 10/2008 | Alexander | 482/29 |
| 2008/0269021 | A1 * | 10/2008 | Publicover | 482/29 |
| 2009/0156366 | A1 * | 6/2009 | Publicover | 482/29 |

FOREIGN PATENT DOCUMENTS

GB 2107199 A * 4/1983

* cited by examiner

*Primary Examiner*—Loan H Thanh
*Assistant Examiner*—Daniel F Roland
(74) *Attorney, Agent, or Firm*—Clement Cheng

(57) ABSTRACT

This trampoline enclosure net design relates to a rebounding mat assembly and an enclosure net that surrounds the periphery of the rebounding mat assembly. The enclosure net is attached to the rebounding mat assembly by the enclosure net poles. The enclosure net pole includes: the body of the pole that is attached to the rebounding mat assembly and a connection assembly that sits at the top end of the body of the pole; a hanging hook is placed at the connection assembly; the hanging hook is connected to the enclosure net pole through an extendable piece. A connection assembly is placed at the top end of the pole; a hanging hook is placed at the connection assembly; the hanging hook is connected to the enclosure net pole through an extendable piece, allowing the enclosure net to expand and contract and buffer impact by user on the enclosure net.

3 Claims, 1 Drawing Sheet

TRAMPOLINE ENCLOSURE NET

This application claims priority from Chinese application for applicant XIANG, Li Ru filed Oct. 29, 2007 having a serial number of 200720058817. X the disclosure of which is incorporated herein by reference.

FIELD OF TECHNOLOGY

The technology of this practical new design is in the field of gymnastic apparatus; it specifically refers to one type of trampoline enclosure net design.

DISCUSSION OF RELATED ART

Presently, trampoline is a gymnastic apparatus that offers the user exercise and entertainment and it is becoming more and more favored by the consumers. Generally, a trampoline is a round frame made up of steel pipes with a rebounding mat tightly attached by many elastic parts to the inner section of the round frame; the rebounding mat is held at a certain height by a multi-legged structure.

Generally, for user safety consideration, an enclosure net needs to be placed around the trampoline in order to ensure that the user will not fall off the trampoline when he/she jumps. Presently, for an enclosure net, usually several enclosure net poles are raised and installed first and then an enclosure net is hung onto the enclosure net poles thereby forming a protective ring that is sealed on four sides so as to ensure the safety of the user. Presently, connection assemblies are placed on the trampoline enclosure net poles for hanging the enclosure net; although these connection assemblies are capable of hanging the enclosure net, the enclosure net lacks certain elasticity because the connection assembly is attached to the enclosure net pole in a stationary manner, as a result it is not capable of buffering the impact caused by the user to the enclosure net and it fails to satisfy the needs of the user. For these reasons, this applicant has satisfied the needs of the users by having create and designed from sensible and practical points of view, a kind of trampoline with an enclosure net that freely expands and contracts.

SUMMARY OF THE INVENTION

This trampoline enclosure net design relates to a rebounding mat assembly and an enclosure net that surrounds the periphery of the rebounding mat assembly. The enclosure net is attached to the rebounding mat assembly by the enclosure net poles. The enclosure net pole includes: the body of the pole that is attached to the rebounding mat assembly and a connection assembly that sits at the top end of the body of the pole; a hanging hook is placed at the connection assembly; the hanging hook is connected to the enclosure net pole through an extendable piece. A connection assembly is placed at the top end of the pole; a hanging hook is placed at the connection assembly; the hanging hook is connected to the enclosure net pole through an extendable piece, allowing the enclosure net to expand and contract and buffer impact by user on the enclosure net.

The purpose of this practical new invention is to provide a kind of trampoline enclosure net design that overcomes the deficiencies of the current stationary parts mentioned above. The technology plan of this practical new design is as follows: the trampoline enclosure net design consists of: a rebounding mat assembly and an enclosure net that surrounds the periphery of the rebounding mat structure; the enclosure net is connected to the rebounding mat assembly through the enclosure net poles; an enclosure net pole includes: the body of the pole that is attached to the rebounding mat assembly and the connection assembly that sits at the top end of the body of the pole; a hanging hook is placed at the connection assembly; the hanging hook is connected to the enclosure net pole through an extendable piece.

One end of the extendable piece is secured within the hollow body of the pole; its other end goes through the upper opening of the body of the pole as well as a hole on the connection assembly and attaches to the hanging hook. One end of the extendable piece is secured to a locking ball which is located within the hollow body of the pole; the locking ball is secured within the body of the pole by positioning screws. Within the connection assembly is placed a roller; the extendable piece goes out through a hole on the side after passing by the roller. The extendable piece can be an elastic cord or a spring.

In this practical new design, as described above, a connection assembly is placed at the top end of the pole; a hanging hook is placed at the connection assembly; the hanging hook is connected to the enclosure net pole through an extendable piece, which allows the enclosure net to expand and contract as well as reduces the impact of the user on the enclosure net; furthermore, it greatly increases the adaptability, comfort, and safety of the trampoline. This practical new design is simple, easy to manufacture, adaptable, and is more competitive in the market.

DETAILED DESCRIPTION OF THE PREFERRED EMBODIMENT

Figure 2:
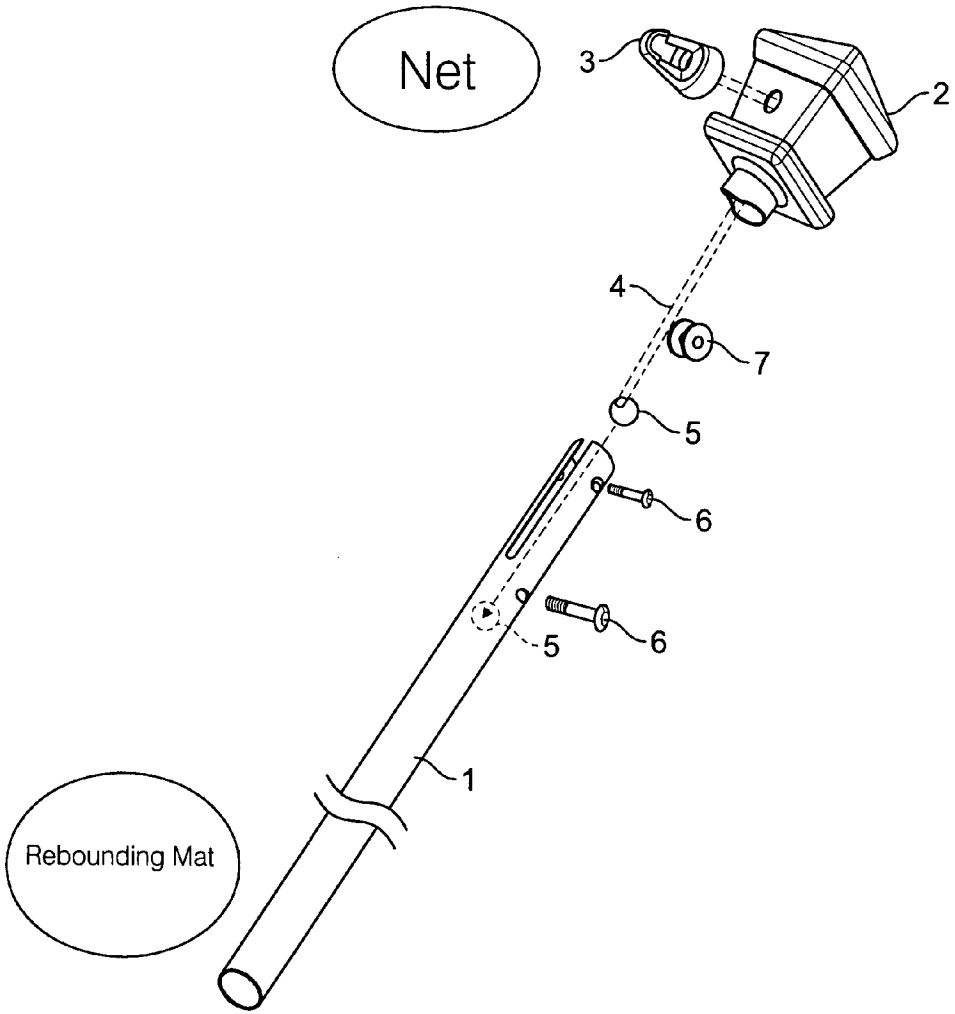
FIG. 2 is the exploded view of the enclosure net pole of this new design.
Figure 1:
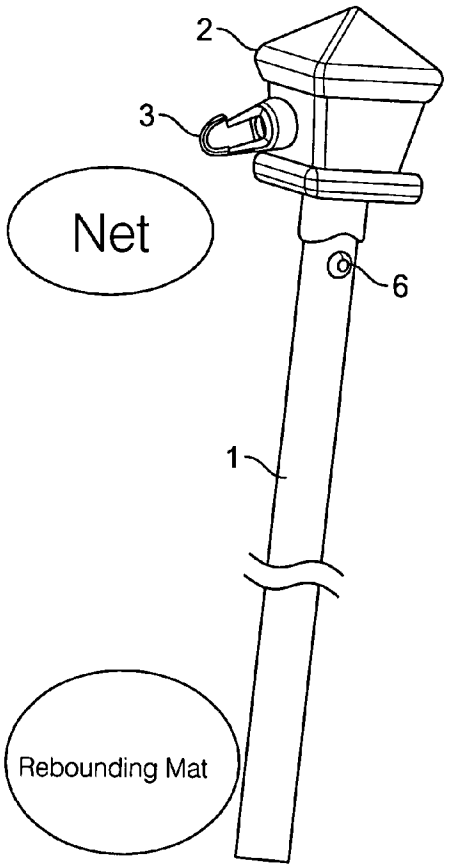
FIG. 1 is the assembled view of enclosure net pole of this new design.

The following combined drawings further explain this practical new design. As shown in FIGS. 1-2, this practical new design includes: the main rebounding mat assembly and the enclosure net that surrounds the rebounding mat assembly; the enclosure net is attached to the rebounding mat assembly through the enclosure net poles.

Specifically, the above-mentioned enclosure net pole is made up of: the body of the pole 1 that is attached to the rebounding mat assembly and the connection assembly 2 that sits at the top end of the body of the pole 1; a hanging hook 3 is placed at the connection assembly 2; the hanging hook 3 is connected to the enclosure net pole through an extendable piece 4. One end of the extendable piece 4 is secured to a locking ball 5 which is located within the hollow body of the pole 1; the locking ball 5 is secured within the body of the pole 1 by positioning screws 6; the other end [of the extendable piece] goes through the upper opening of the body of the pole 1 as well as a hole on the connection assembly 2 and attaches to a hanging hook 3. Furthermore, the above-mentioned hanging hook 3 and locking ball 5 are connected to each other by the extendable piece 4; to ensure that the extendable piece 4 between the hanging hook 3 the and locking ball 5 works smoothly, a roller 7 is placed inside the connection assembly 2; the extendable piece 4 goes out of the connection assembly 2 through a hole on the side after passing by the roller 7.

Of course, the extendable piece 4 can be an elastic cord or a spring. Summarizing the above, in this practical new design, a connection assembly is placed at the top end of the pole; a hanging hook is placed at the connection assembly; the hanging hook is connected to the enclosure net pole through an extendable piece, which allows the enclosure net to expand and contract and reduces the impact of the user on the enclosure net; furthermore, it greatly increases the adaptability, comfort, and safety of the trampoline. This practical new design is simple, easy to manufacture, adaptable, and is more competitive in the market.

Of course, the above description provides merely an example application of this practical new design and it is not intended to limit the scope of application of this new design; all changes or modifications that employ the designs, characteristics, or principles described in the patent application of this practical new design shall be included within the scope of the patent application of this practical new design.

The invention claimed is:

1. A trampoline enclosure comprising: a net; an enclosure net pole for mounting the net, the enclosure net pole further comprising: a pole body attached to a rebounding mat assembly; a connection assembly that sits at a top end of the pole body; a hanging hook placed at the connection assembly; the hanging hook connected to the enclosure net pole through an extendable piece, wherein one end of the extendable piece is secured to a locking ball which is located within the pole body by positioning screws; wherein an other end of the extendable piece goes through an upper opening of the pole body as well as a hole on the connection assembly and attaches to the hanging hook, wherein the hanging hook and locking ball are connected to each other by the extendable piece; wherein to ensure that the extendable piece between the hanging hook and the locking ball works smoothly, a roller is placed inside the connection assembly, wherein the extendable piece is a spring.

2. A trampoline enclosure comprising: a net; an enclosure net pole for mounting the net, the enclosure net pole further comprising: a pole body that is hollow and attached to a rebounding mat assembly; a connection assembly that sits at a top end of the pole body; a hanging hook placed at the connection assembly; the hanging hook connected to the enclosure net pole through an extendable piece, wherein one end of the extendable piece is secured to a locking ball which is located within the hollow pole body by positioning screws; wherein an other end of the extendable piece goes through an upper opening of the hollow pole body as well as a hole on the connection assembly and attaches to the hanging hook, wherein the hanging hook and locking ball are connected to each other by the extendable piece; wherein to ensure that the extendable piece between the hanging hook and the locking ball works smoothly, a roller is placed inside the connection assembly, wherein the extendable piece is a spring.

3. A trampoline enclosure comprising: a net; an enclosure net pole for mounting the net, the enclosure net pole further comprising: a pole body attached to a rebounding mat assembly; a connection assembly that sits at a top end of the pole body; a hanging hook placed at the connection assembly; the hanging hook connected to the enclosure net pole through an extendable piece, wherein one end of the extendable piece is secured to a locking ball which is located within the pole body; wherein the locking ball is secured within the pole body; wherein an other end of the extendable piece goes through an upper opening of the pole body as well as a hole on the connection assembly and attaches to the hanging hook, wherein the hanging hook and locking ball are connected to each other by the extendable piece; wherein to ensure that the extendable piece between the hanging hook and the locking ball works smoothly, a roller is placed inside the connection assembly, wherein the extendable piece is a spring.

* * * * *